United States Patent [19]

Sakamoto et al.

[11] 4,412,736

[45] Nov. 1, 1983

[54] COLLECTION OF SUSPENDED TONER PARTICLES

[75] Inventors: Koji Sakamoto, Tokyo; Misao Tanzawa, Kawasaki, both of Japan

[73] Assignee: Ricoh Company, Ltd., Japan

[21] Appl. No.: 286,041

[22] Filed: Jul. 22, 1981

[30] Foreign Application Priority Data

Jul. 24, 1980 [JP] Japan ..... 55-101633
Jul. 24, 1980 [JP] Japan ..... 55-104869[U]

[51] Int. Cl.[3] ..... G03G 21/00
[52] U.S. Cl. ..... 355/15; 15/256.52
[58] Field of Search ..... 355/15; 15/256.5, 256.51, 15/256.52, 1.5; 134/1; 118/652

[56] References Cited

U.S. PATENT DOCUMENTS 3,955,235 5/1976 Meyer ..... 355/15 X
4,319,832 3/1982 Sakamoto et al. ..... 355/15

*Primary Examiner*—R. L. Moses
*Attorney, Agent, or Firm*—Guy W. Shoup; Eliot S. Gerber

[57] ABSTRACT

Apparatus for collecting charged toner particles suspended in an air flow is provided. The present apparatus is particularly useful when used in combination with a fur brush cleaning device of a transfer type electrophotographic copying machine. The present collection apparatus comprises a roller electrode and a counter electrode disposed opposite to the peripheral surface of the roller electrode. A blade is provided in contact with the roller electrode. The roller electrode includes an insulating section which always keeps in contact with a portion of the blade thereby roller and counter electrodes are prevented from being bridged by deposited toner particles. A disposable filter unit may be advantageously mounted on the collection apparatus.

13 Claims, 5 Drawing Figures

COLLECTION OF SUSPENDED TONER PARTICLES

BACKGROUND OF THE INVENTION

1. Field of the Invention

This invention relates to collection of suspended particles and more in particular to a cleaning device of an electrophotographic copying machine for cleaning the surface of a photosensitive member by removing and collecting the toner particles remaining thereon. More specifically, the present invention relates to an apparatus for collecting suspended toner particles with high efficiencies.

2. Description of the Prior Art

In a transfer type electrophotographic copying machine, a toner image is formed on the surface of a photosensitive member by going through the steps of an electrophotographic image forming process and a copy paper is brought into contact with the surface of the photosensitive member to transfer the toner image onto the copy paper. After the transfer step, there remains toner particles on the surface of the photosensitive member which have not been transferred. As a preparation for the next cycle of copying operation, these residual toner particles must be removed from the surface of the photosensitive member.

Customarily, use has been made of several cleaning techniques such as blade cleaning, fur-brush cleaning, web cleaning, etc. In the fur-brush cleaning technique, the toner particles remaining on the surface of the photosensitive member are scraped off by the fur brush and the thus scraped-off toner particles are then removed from the fur brush to be suspended to an air flow which is led into a filter chamber for collecting the suspended toner particles by a filter. Such a conventional fur-brush cleaning technique is impracticable in many respects, however. For example, filters must be replaced quite often since a relatively large amount of toner particles is collected. If it is desired to use a filter for a longer period of time, there must be provided an air flow having a sufficient momentum to overcome the pressure drop caused by plugging of the filter interstices by the collected toner particles. This then requires to increase the rotational velocity of the fur brush or to provide a suction device at the downstream end.

One prior art approach to cope with the above-described problems of the fur-brush cleaning technique is shown in FIGS. 1 and 2. As shown, a photosensitive member 1 moves in the direction indicated by the arrow A and toner particles 2 are carried on the surface of the photosensitive member 1. A fur brush 3 is driven to rotate in the direction indicated by the arrow B and therefore the toner particles 2 are scraped off by the fur brush 3. An obstruction plate 4 is provided in engagement with the fur brush 3. Thus, as the fur brush 3 rotates, the toner particles are removed from the fur brush 3 by the obstruction plate 4 and they become suspended in an air flow caused by the rotation of the fur brush 3.

Then the air flow with the suspension of toner particles is directed to a passage defined between a roller electrode 5 and a counter electrode 6. A high voltage V of the negative polarity is applied to the roller electrode 5 and the counter electrode 6 is grounded so that an electric field is formed therebetween. Toner particles in the air flow still retain charges and, in this case, it is assumed that the toner particles are positively charged.

Thus, the toner particles in the air flow are attracted toward the roller electrode 5 and collected on the peripheral surface thereof. The roller 5 is driven to rotate in the direction indicated by the arrow C and a flexible blade 7 is provided in contact with the peripheral surface of the roller 5. Thus, as the roller 5 rotates, the toner particles now collected on the roller 5 are scraped off by the blade 7 and transported into a toner collection chamber 8. The toner particles collected in the chamber 8 may be further transported to a developing station (not shown) of a copying machine for reuse. On the other hand, the air flow from which the suspended toner particles have been removed is led into a filter chamber 9 and discharged out into the exterior through a filter 11.

FIG. 2 is a vertical cross-section of the roller 5 and its surrounding elements of the device shown in FIG. 1. The roller 5 is rotatably journaled to a support member 11 of an electrically insulating material. The support member 11 also constitutes sidewalls of the air flow passage. In the absence of toner particles, even if a high voltage is applied between the electrodes 5 and 6, a breakdown through the support member 11 may be prevented from occurring by selecting an appropriate material for the support member 11. However, when an air flow with suspension of toner particles is pressed through the passage, the toner particles are mostly collected on the roller 5 and, at the same time, some of the toner particles are collected on the support member 11 as well as the electrode 6 to form a thin toner layer thereon. For the sake of simplicity, only the toner layer 12 formed on the support member 11 is shown in FIG. 2. Repulsion between likely charged particles and fluid-dynamic turbulence would cause some of the suspended toner particles to be deposited on the support member 11.

Since a high voltage is applied between the electrodes 5 and 6 and the toner layer 12 may be formed to bridge these electrodes, a creeping discharge could occur along the toner layer 12. Once occurred, the high voltage can no longer be sustained between the electrodes 5 and 6 because a leakage path is created along the toner layer 12. Studies have shown that the measured resistance between the electrodes 5 and 6 prior to the occurrence of creeping discharge was approximately 100 megohms for a particular setup with the application of 5 kV high voltage and the resistance dropped to about 1 kilohms after the occurrence of creeping discharge. Therefore, the applied voltage must be lowered after the occurrence of creeping discharge, which necessarily reduces the collection efficiency of the toner particles. Moreover, creeping discharge could cause damages not only to the electrodes and the support member, but also to the voltage supply and its control circuit. Particularly in the case of a copying machine, it is hazardous for the machine operator.

SUMMARY OF THE INVENTION

The disadvantages of the prior art are overcome with the present invention and an improved apparatus for collecting suspended toner particles is provided.

The advantages of the present invention are attained by removing at least a part of the toner layer formed on the support member so that the toner layer 12 does not bridge a pair of opposing electrodes. Preferably, the electrode roller is comprised of an electrically conductive middle section and electrically insulating end sections provided on both ends of the middle section. With such a structure, the creeping distance between the opposing electrodes is increased and the toner layer is prevented from bridging between the electrodes.

Therefore, it is an object of the present invention to provide an improved apparatus for collecting particles suspended in the air.

Another object of the present invention is to provide an apparatus for collecting suspended particles which has a guaranteed high collection efficiency and therefore a long service life.

A further object of the present invention is to provide an apparatus for collecting suspended toner particles particularly useful for use in a transfer type electrophotographic copying machine.

A still further object of the present invention is to provide an apparatus for collecting suspended toner particles in which creeping discharge is prevented from occurring.

A still further object of the present invention is to provide an apparatus for collecting suspended particles for use in a copying machine, which is greatly improved in convenience and simplified in structure.

Other objects, advantages and novel features of the present invention will become apparent from the following detailed description of the invention when considered in conjunction with the accompanying drawings.

DESCRIPTION OF THE PREFERRED EMBODIMENTS

Figure 3:
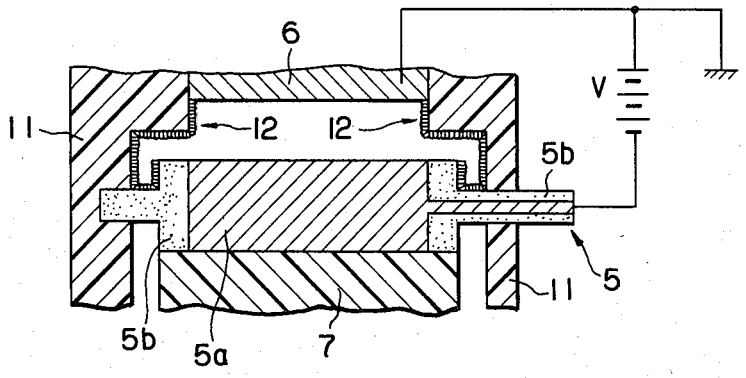
FIG. 3 is a schematic illustration in cross-section showing one embodiment when the present invention is applied to the structure shown in FIG. 2.

Referring now to FIG. 3 which shows one embodiment of the present invention, the roller 5 is comprised of three sections: electrically conductive middle section 5*a* and a pair of electrically insulating end sections 5*b*, 5*b* provided on respective ends of the middle section 5*a*. In the embodiment shown in FIG. 3, the length of the conductive middle section 5*a* is selected in correspondence with the counter electrode 6, thereby avoiding the formation of a skewed electric field as much as possible. The middle section 5*a* may be made of any appropriate conductive material such as stainless steel and brass. The end sections 5*b*, 5*b* may be made of any appropriate insulating material such as polyvinyl acetal, nylon or any other insulative resin materials.

Importantly, in the embodiment shown in FIG. 3, the end sections 5*b*, 5*b* are in contact with the blade 7. From the spirit of the present invention, it is preferable that the contact line between the blade 7 and the end section 5*b* be as long as possible. However, from a practical view point, the length of the contact line may be appropriately selected with ease by those skilled in the art in view of the voltage applied to the conductive section 5*a*.

A high voltage V is applied between the middle section 5*a* of the roller electrode 5 and the counter electrode 6. If use is made of positively charged toner particles, a high voltage of the negative polarity is usually applied to the roller 5 with the counter electrode 6 connecting to the ground. For example, −5 kV is applied to the roller 5 for the distance between the electrodes 5 and 6 of 7 mm. Thus, the positively charged particles will be mostly collected on the middle section 5*a*. From various reasons, some of the toner particles will also be deposited on the end sections 5*b*, 5*b* and the support member 11 to form the toner layer 12.

However, in the structure shown in FIG. 3, each of the end sections 5*b*, 5*b* is partly in sliding contact with the blade 7. Accordingly, as the roller 5 rotates, that portion of the toner layer 12 on each of the end sections 5*b*, 5*b* which comes into contact with the blade 7 is scraped off so that the part of each of the end sections 5*b*, 5*b* that comes into contact with the blade is kept free of toner particles at all times. Accordingly, the toner layer 12 is prevented from bridging between the middle section 5*a* and the counter electrode 6. This allows to the resistance between the electrodes to be maintained at a high value. It should also be noted that such a resistive value may be kept at an intended value. It should further be noted that provision of an insulating section on both ends of the roller 5 effectively increases the creeping distance between the opposing electrodes, which also contributes to increase the creeping breakdown voltage.

It should be understood that the present invention is not to be limited to the structure shown in FIG. 3. For example, the roller 5 may be provided with projecting means having a part which is in contact with the support member 11. Such a structure also allows to provide a discontinuity in the toner layer 12 thereby preventing the toner layer from bridging between the opposing electrodes. Moreover, use may be made of a purgeing air flow or rapping means to remove at least a part of the toner layer 12.

Figure 1:
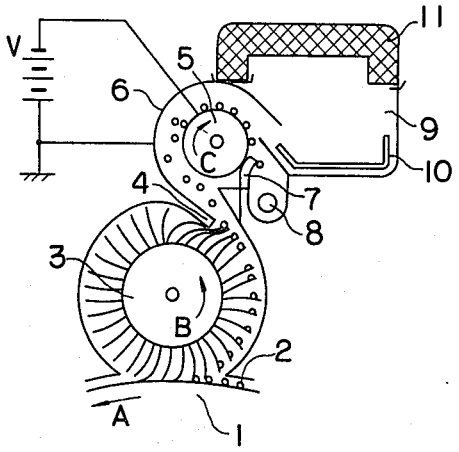
FIG. 1 PRIOR ART
FIG. 1 is a schematic illustration of the prior art cleaning device of an electrophotographic copying machine.
Figure 2:
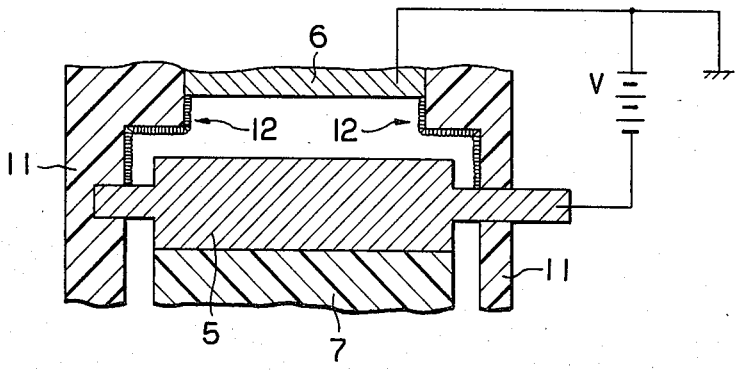
FIG. 2 PRIOR ART
FIG. 2 is a schematic illustration in cross-section showing the detailed structure of the roller electrode and its associated elements of the cleaning device shown in FIG. 1.

Returning back to FIG. 1, a receptacle 10 is placed on the bottom of the filter chamber 9 and a filter 11 is detachably mounted to cover the top opening of the chamber 9. In the case of the cleaning device for use in an electrophotographic copying machine, foreign matter such as brush fragments, copy paper fragments and debris is also collected. Such a foreign matter is usually not collected electrostatically but deposited on the receptacle 10. On the other hand, weakly charged toner particles and conductive matter which have failed to be collected electrostatically are collected by the filter 11. With such a prior art structure, the filter 11 must be removed once in a while to clean the receptacle 10 or for other maintenance purposes. When the filter 11 is removed, some of the collected materials tend to be scattered around. The same arguments hold true when the receptacle 10 is taken out of the chamber 9 for cleaning. As described above, the prior art filter chamber 9 is disadvantageous because handling of collected materials is quite difficult and awkward. It should be noted that toner particles include organic materials and disposal thereof should be done under strict control.

Figure 4:
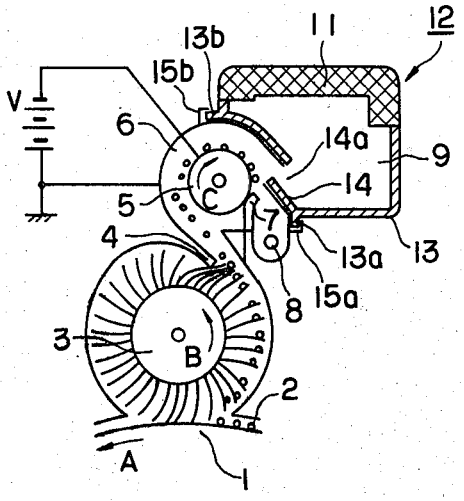
FIG. 4 is a schematic illustration showing the state when a detachable filter unit of the present invention is mounted on the cleaning device of an electrophotographic copying machine.
Figure 5:
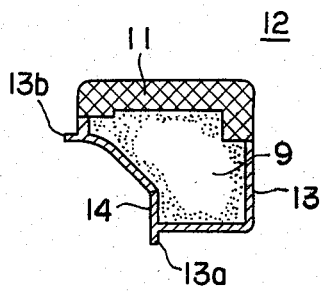
FIG. 5 is a schematic illustration showing the detached state of the filter unit of the present invention.

As shown in FIGS. 4 and 5, the present invention proposes to provide a disposable filter unit 12 which is generally in the shape of a box. FIG. 4 shows the state when the present filter unit 12 is mounted on the cleaning device; FIG. 5 shows the state when the unit 12 is detached from the cleaning device. As shown, the unit 12 comprises a box member 13 and a filter 11 which is fixed to the box member 13 as a unit. The filter chamber 9 is the inside space defined by the box member 13 and the filter 11. A portion of the box member 13 is defined as a door portion 14 which can be bent out to define an opening 14*a*. When the filter unit 12 is mounted as shown in FIG. 4, the door portion 14 can be bent out to direct the opening 14*a* toward the passage to let the air flow come into the filter chamber 9.

The box member 13 is provided with projections 13*a* and 13*b* which may be fit into hook portions 15*a* and 15*b*, respectively, for mounting. Any material may be selected for forming the box member 13, whether conductive or not, but thick paper having flexibility such as cardboard may be preferably used. For the filter 11, such material as nonwoven fabric, sponge rubber, filter paper, etc. may preferably be used. Preferably, the filter 11 is glued to the box member 13. If it is desired to detach the filter unit 12, it is only necessary to squeeze the unit 12 a little bit by fingers to disengage the projections 13*a* and 13*b* from the hook portions 15*a* and 15*b*, respectively. Preferably, the door portion 14 has a tendency to keep the closed position as shown in FIG. 5 and it is forced to take the open position as shown in FIG. 4 when the projection 13*a* is in engagement with the hook portion 15*a*. If so structured, the door portion 14 takes the closed position as soon as the filter unit 12 has been detached from the cleaning unit to minimize the possibility of scattering the collected materials. Furthermore, since the present filter unit 12 is disposable, the handling of toner particles can be done under control at all times and there is no possibility of contaminating the surrounding area.

While the above provides a full and complete disclosure of the preferred embodiment of the present invention, various modifications, alternate constructions and equivalents may be employed without departing from the true spirit and scope of the invention. Therefore, the above description and illustration should not be construed as limiting the scope of the invention, which is defined by the appended claims.

What is claimed is:

1. Apparatus for collecting suspended, charged particles comprising:

a support member;

a roller electrode rotatably supported by said support member and including an electrically insulating section provided at least at a part of the peripheral surface of said roller electrode;

a counter electrode disposed opposite to the peripheral surface of said roller electrode;

a blade provided in contact with the peripheral surface of said roller electrode, said blade being also in contact with at least a part of said insulating section thereby preventing said roller and counter electrodes from being bridged through the particles deposited on said support member; and a high voltage source connected between said roller electrode and said counter electrode.

2. The apparatus of claim 1 wherein said roller electrode includes an electrically conductive section and at least a pair of electrically insulating sections provided on respective ends of said conductive section and said blade is in contact with at least a part of each of said insulating sections.

3. The apparatus of claim 2 wherein the length of said conductive section along its axis is substantially the same as the width of said counter electrode.

4. The apparatus of claim 1 wherein said high voltage source applies a negative high voltage to said roller electrode with grounding said counter electrode.

5. The apparatus of claim 1 wherein said particles are toner particles.

6. Apparatus for collecting charged particles suspended in a gas flow comprising:

a channel formed at least partially by electrically insulative portions for passing said gas flow with the suspension of charged particles;

a pair of electrodes oppositely disposed in said channel;

means for applying a high voltage between said electrodes; and means for removing at least a part of the particles deposited on electrically insulative portions of said channel so as to prevent said electrodes from being bridged through the particles deposited on said electrically insulative portions of said channel.

7. The apparatus of claim 6 further comprising a filter unit detachably mounted at the outlet of said channel, said filter unit including a box member provided with an opening and a door portion, and a filter fixed to said opening of the box member.

8. The apparatus of claim 7 wherein said door portion has a tendency to keep a closed position and said door portion is forced to take an open position when said filter unit is mounted on said apparatus.

9. The apparatus of claim 6 further comprising a support member for supporting said pair of electrodes and said channel is defined by said support member and said pair of electrodes.

10. The apparatus of claim 9 wherein one of said pair of electrodes is a roller electrode rotatably supported by said support member and the other electrode is a counter electrode disposed opposite to the peripheral surface of said roller electrode with a predetermined distance therebetween.

11. The apparatus of claim 10 further comprising a blade disposed in contact with the peripheral surface of said roller electrode.

12. The apparatus of claim 11 wherein said means for removing includes an electrically insulating section provided on said roller electrode and said insulating section keeps contact with said blade even if said roller electrode rotates.

13. In an apparatus for collecting particles suspended in a flow of gas, comprising means including a channel for passing said flow of gas with the particles; and a filter unit detachably mounted at an outlet of said channel, said filter unit including a door portion having a tendency to be closed, and means provided in said apparatus to hold said door portion in an open position when said filter unit is mounted in place within said apparatus and to allow said door portion to move into a closed position when said filter unit is removed from said apparatus.

* * * * *